US008607425B2

(12) United States Patent
Guo et al.

(10) Patent No.: US 8,607,425 B2
(45) Date of Patent: Dec. 17, 2013

(54) METHOD FOR LUBED TAPE BURNISH FOR PRODUCING THIN LUBE MEDIA

(75) Inventors: Xing-Cai Guo, Tracy, CA (US); Thomas E. Karis, Aromas, CA (US); Bruno Marchon, Palo Alto, CA (US)

(73) Assignee: HGST Netherlands B.V., Amsterdam (NL)

( * ) Notice: Subject to any disclaimer, the term of this patent is extended or adjusted under 35 U.S.C. 154(b) by 355 days.

(21) Appl. No.: 13/040,652

(22) Filed: Mar. 4, 2011

(65) Prior Publication Data

US 2012/0222276 A1 Sep. 6, 2012

(51) Int. Cl.
*B24B 39/00* (2006.01)

(52) U.S. Cl.
USPC ..... 29/90.01

(58) Field of Classification Search
USPC ..... 29/90.01, 90.5, 458, 460; 451/302, 206, 451/303, 59, 299, 307; 407/127; 508/110
See application file for complete search history.

(56) References Cited

U.S. PATENT DOCUMENTS

| | | | |
|---|---|---|---|
| 6,521,286 | B2 | 2/2003 | Isozaki |
| 7,276,262 | B2 | 10/2007 | Giorgi et al. |
| 2007/0248749 | A1 | 10/2007 | Guo et al. |
| 2009/0128951 | A1 | 5/2009 | Guo |
| 2010/0003900 | A1 | 1/2010 | Sakaguchi et al. |
| 2010/0003901 | A1 | 1/2010 | Sakaguchi et al. |
| 2010/0221416 | A1 | 9/2010 | Guo et al. |

FOREIGN PATENT DOCUMENTS

| | | | |
|---|---|---|---|
| JP | 61086169 | A | 5/1986 |
| JP | 62103890 | A | 5/1987 |
| JP | 3237619 | A | 10/1991 |
| JP | 8069620 | A | 3/1996 |
| JP | 2010170640 | A | 8/2010 |

OTHER PUBLICATIONS

John Skoufis et al., "Low-Contamination Fabric Tapes for Disk Polishing, Texturing, and Buffing," Journal of the Institute of Environmental Sciences, May/Jun. 1997, pp. 28-32.

*Primary Examiner* — John C Hong

(57) ABSTRACT

A method of processing media comprises bonding a high molecular weight first lubricant to media; loading and rotating the media in a burnishing device; applying a tape to the rotating media while applying a second lubricant to the tape, such that at least some of the second lubricant is transferred from the tape to the media; and evaporating substantially all of the second lubricant from the polished media within 24 hours. The second lubricant may comprise a low molecular weight, non-functional, free lubricant that does not bond with the media.

20 Claims, 3 Drawing Sheets

METHOD FOR LUBED TAPE BURNISH FOR PRODUCING THIN LUBE MEDIA

BACKGROUND OF THE INVENTION

1. Field of the Disclosure

The present invention relates in general to storage media and, in particular, to a method for lubed tape burnish for producing thin lube media.

2. Description of the Related Art

Hard disk drives read from and write to magnetic patterns on magnetic media. Hard disk drives have been used for over forty years to store digital data, and offer low cost, high recording capacity, and relatively rapid data retrieval. While the basic principle of reading and writing magnetic patterns on rotating disks remains the same, components of the disk drive, particularly the read-write head and the disks have significantly evolved.

Thin films of magnetic metal are typically sputtered on a platter to form a magnetic media disk. Thin films allow more narrow magnetic cells, which represent a data bit, to be formed. The narrower magnetic cell results in higher recording and storage densities. Additionally, metallic thin films with limited surface roughness may be formed on a very smooth platter. Smooth films allow the head to "fly" closer to the magnetic cells, yielding higher read-back amplitudes.

Surface roughness limits how low a head can approach the media, and adds to the overall contribution of noise from the magnetic layer of magnetic media disks. Advancements in the design of recording heads, particularly the introduction of magneto-resistive heads, also call for continuing reductions in surface roughness.

Pad burnish is an important process in manufacturing magnetic recording media following sputter deposition of magnetic layers, deposition of an overcoat and lubricant dipping. The purpose of pad burnish is to polish off high asperities on the disk surface and thus to increase glide yield. However, poor burnish often damages the disk by causing overcoat scratches and producing solid particles, which leads to poor corrosion resistance and low glide yield. It has been known that a minimum amount of mobile (unbonded) lubricant is required to minimize damage to the disk, exemplified by the glide yield versus time delay of sputter-to-lube or lube-to-burnish. Longer sputter-to-lube delay decreases the initial bonded fraction of lubricant (due to contamination of water and organics), whereas longer lube-to-burnish delay increases the bonded fraction (governed by lubricant bonding kinetics). Therefore, longer sputter-to-lube delay and shorter lube-to-burnish delay produce high glide yield.

However, too much free lubricant causes severe flyability problems, such as lube pick-ups, moguls and depletion, and also reduces magnetic clearance. The total lubricant thickness is limited in order to reduce magnetic spacing and achieve high areal density.

One conventional solution discloses a mixture of both low and high molecular weight lubricants applied to media. See, e.g., U.S. App. Pub. 2007/0248749, to Guo et al, which is incorporated herein by reference. This design reduces burnish damage and increases glide yield without compromising disk flyability, durability and general quality. However, this method also includes a fixed time delay for lube-to-burnish, which can affect manufacturing considerations. Thus, improvements in lubrication design and implementation continue to be of interest.

SUMMARY

Embodiments of a system, method and apparatus for processing media are disclosed. In some embodiments, a method of processing media comprises bonding a high molecular weight first lubricant to media; loading and rotating the media in a burnishing device; applying a tape to the rotating media while applying a second lubricant to the tape, such that at least some of the second lubricant is transferred from the tape to the media; and evaporating substantially all of the second lubricant from the polished media within 24 hours. The second lubricant may comprise a low molecular weight, non-functional, free lubricant that does not bond with the media.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

Figure 1:
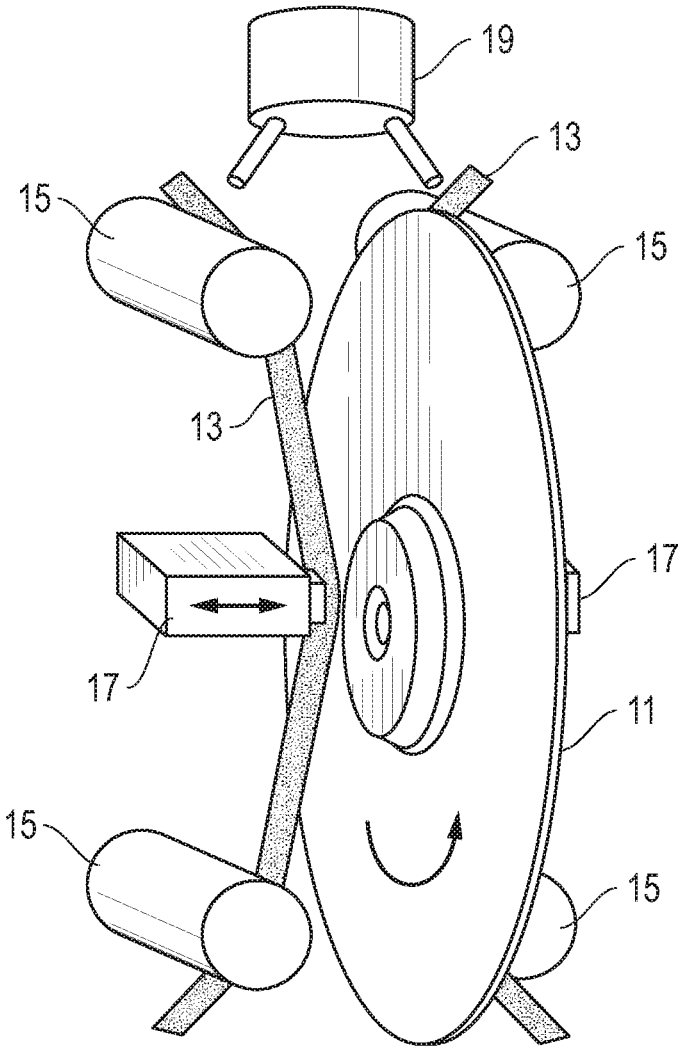
FIG. 1 is a schematic isometric view of an embodiment of a burnishing apparatus and method.

Before describing the embodiments in detail, it is to be understood that they are not limited to specific methods, processes, or device structures, as such may vary. It is also to be understood that the terminology used herein is for the purpose of describing particular embodiments only, and is not intended to be limiting. The following terminology will be used in accordance with the definitions set out below.

A "hard disk drive" (HDD, or also hard drive) is a non-volatile data storage device that stores data on a magnetic surface layered onto hard disk platters.

The term "DLC" or diamond-like carbon refers to many new forms of carbon which have both graphitic and diamond-like characteristics. DLC has many possible material properties as it becomes more diamond-like and crystalline. Its density is between graphite and diamond. The optical properties are diamond-like in index of refraction but a high extinction coefficient makes them dark. DLC is being used in the semiconductor industry and as a wear resistant coating for disks used in hard disk drives.

The term "asperity" refers to a peak above the mean roughness of the disk surface. Disk asperities can result in disk failure. During disk testing test parameters such as glide height (the fly height of the glide head) and glide hits (the number of hits which occur during glide testing) are adjusted and controlled for different head designs in different HDD products.

The term "flyability" refers to a performance criterion for a magnetic disk; the ability of a read/write head to travel over a disk surface in an operative mode, i.e. a read/write mode, for a substantial period of time without interference from asperities on the disk.

The term "glide yield" refers to a measure of disk failure when the disk surface is tested with a glide head for asperities: (disks tested-disks failed)/disks tested*100=glide yield (%).

The term "high molecular weight" or "high MW" lubricant refers to lubricants that range in molecular weight from about 2000 to 10000 g/mol. Examples of high MW lubricants are ZTMD (molecular weight=2460) and Z-Tetraol. If a high MW lubricant with strong bonding properties and a low MW free lubricant were applied to a coated magnetic disk, the combination is particularly useful during the burnish cycle of the disk manufacturing process, first to protect the disk during burnish, then to provide a lubricated surface following burnish, when the bonded high MW lubricant remains attached to the disk, improving glide yield and flyability.

The term "longitudinal recording" refers to recording on a collection of magnetized particles having their respective north and south poles lined parallel to a disk's surface in a ring around its center. In a magnetic disc drive, digital information is written on tiny magnetic bits. When a bit is written, a magnetic field produced by the disc drive's read/write head orients the bit's magnetization in a particular direction, corresponding to either a 0 or 1. The magnetism in the head in essence "flips" the magnetization in the bit between two stable orientations.

The term "low molecular weight" or "low MW" lubricant refers to lubricants that range in molecular weight from 500-1900. Examples of low MW lubricants are Z950, Z1080, Z1330 and Z1650 fractionated by supercritical fluid extraction from Fomblin Z02®. The lubricants tend to slowly evaporate at ambient temperatures or temperatures slightly elevated above ambient temperatures within a few hours to a few days.

The term "perpendicular recording" refers to data recording on a hard disk in which the poles of the magnetic bits on the disk are aligned perpendicularly to the surface of the disk platter. Perpendicular recording can delivers increased storage density as compared to longitudinal recording.

The term "substantially" as in, for example, the phrase "substantially identical elements," refers to elements that do not deviate by more than 10%, preferably not more than 5%, more preferably not more than 1%, and most preferably at most 0.1% from each other. Similarly, the phrase "substantially identical elements" refers to elements that do not deviate in physical properties. For example "substantially identical elements" differ by more than 10%, preferably not more than 5%, more preferably not more than 1%, and most preferably at most 0.1% from each other. Other uses of the term "substantially" involve an analogous definition.

The term "substrate" as used herein refers to any material having a surface onto which a coating may be applied. In the preferred embodiment of the present invention the substrate is a disk having a magnetic coating and used in a data storage device such as a disk drive. Substrates are typically glass or aluminum.

The embodiments disclosed herein provide a novel method for reducing pad burnish damages on magnetic recording media wherein a high molecular weight non-functional free lubricant is used separately but in combination with a low molecular weight lubricant. The first lubricant is applied and bonded to the read/write surface of magnetic recording disk. The disk surface is then burnished with tape and the second lubricant to remove asperities there from. The low molecular weight free lubricant evaporates from the disk at ambient temperatures following burnish and during post-lube treatment and before glide and flyability tests or drive build, leaving a thin layer of highly bonded, high molecular weight lubricant on the disk surface. The method reduces burnish damage and increases glide yield without compromising disk flyability, durability and general quality.

To minimize asperities, HDD manufacturer typically subject a DLC overcoat of the disk to a burnish cycle in which the overcoat is buffed using a burnish pad and abrasive tape to smooth the overcoat and remove asperities there from. The burnish cycle does not involve dry buffing of the DLC overcoat, since dry buffing to likely to increase surface roughness, not reduce it. Accordingly, prior to burnish, a lubricant layer is applied to the overcoat. The thickness of the lubricant layer is sufficient to substantially cover all of the asperities in the overcoat. The lubricant used may comprise a first, high molecular weight (MW) free and bonded non-volatile lubricant, and a separately applied, low MW volatile free lubricant.

The high MW lubricant has good bonding properties such as ZTMD. A commercially available high MW lubricant usable in the present application is Z-Tetraol. The low MW lubricant with a low bonded ratio may comprise Fomblin Z®. Other similar low MW lubricants may include Z and Z-dol.

To form the disks, a magnetic layer is deposited or applied onto a substrate using any of various deposition techniques known in the art, such as sputtering, electron-beam lithography and nanoimprint. A protective layer may be deposited or applied onto the magnetic layer using any of various deposition techniques known in the art, such as ion beam deposition and filtered cathodic arc deposition. A functional lubricant is then deposited or applied onto the protective layer by any of various techniques, such as liquid dipping and vapor deposition.

Figure 2:
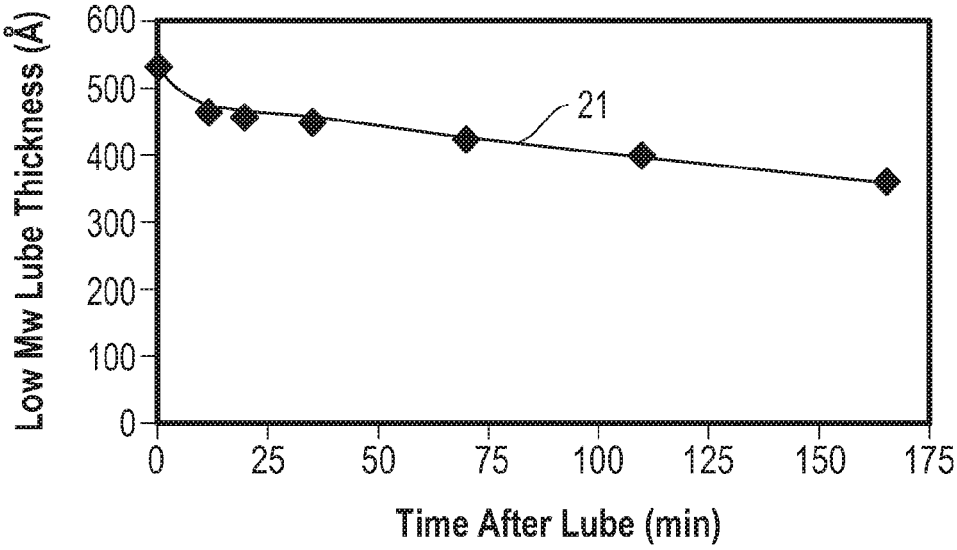
FIG. 2 is a plot of thickness of lubricant on tape over time.

As depicted in FIG. 1, the burnish process may include a mounted and rotatable disk 11 (a two-sided disk is shown), tape 13 mounted on spools 15 adjacent the disk 11, and a mechanism 17 for moving the tape into contact with the surface of the disk 11. A non-functional lubricant 19 is applied to the tape 13. Lubricant 19 may be applied to tape 13 by dripping from above or wiping, for example. The lubricant 19 facilitates the burnish process, enabling the burnish pad to knock down and smooth asperities in the overcoat while protecting the surface of the overcoat from being roiled during the burnish process. During the burnish process, a portion of the low MW lubricant 19 is transferred from the tape 13 to the disk 11, and some of it evaporates during the burnish process. FIG. 2 is a plot 21 of the thickness of the lubricant on the tape over time.

Figure 3:
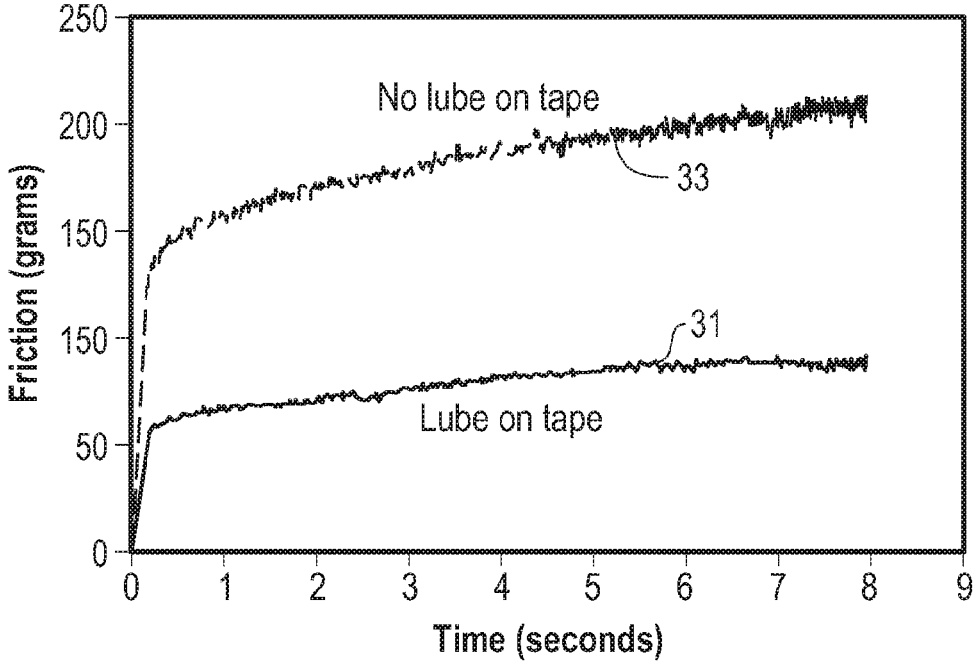
FIG. 3 is a plot comparing friction between media and lubricated and unlubricated tapes radially across media from inner diameter to outer diameter.

FIG. 3 depicts plots comparing friction between media and lubricated tape 31 and unlubricated tape 33 radially across media from inner diameter to outer diameter. Tapes lubricated in accordance with embodiments disclosed herein have significantly lower friction than unlubricated tapes.

Following burnish, the remaining low MW lubricant evaporates from the disk at ambient temperatures or during post-lube treatment. As time elapses, the low MW non-functional Z lubricants substantially completely evaporate from the disk. This leaves only the layer of highly bonded, high MW lubricant on the overcoat of the disk. Burnishing the disk with a non-functional, bondless lubricant reduces damage to the disk often caused by functional, bonding lubricants. Accordingly, disks made according to the method described herein can be more corrosion-resistant than media made using conventional methods.

In one embodiment, to promote evaporation (if needed), the disk may be allowed to rest in an environment under normal ambient conditions for a predetermined period of time. For example, in some instances, the disk may be exposed to ambient air at room temperature for at least several hours. The ambient conditions may be at least partially based on the type of non-functional lubricant used in the burnishing process.

In other embodiments, the evaporation of the lubricant can be accelerated or delayed by modifying the conditions of the environment in which the lubricant is exposed. For example, in some implementations, the evaporation of the lubricant can be accelerated by increasing the temperature of the environment, such as by placing the lubricated disk in a heated oven. In some instances, the temperature of the environment is incrementally increased over time. In some implementations, in addition to, or in place of, ambient air, the environment can contain an evaporation promoting material, such as nitrogen gas or clean dry air. Additionally, evaporation of the lubricant can be promoted by convection, e.g., moving ambient or heated air, nitrogen gas, clean dry air, or other fluid, across the lubricant, by microwave radiation from a microwave oven, and/or infrared light from an infrared lamp.

Generally, a non-functional lubricant is a lubricant without a functional end group. Further, non-functional lubricants generally have a lower molecular weight, higher evaporation rate or weight loss, higher volatility, and a lower tendency to bond to other surfaces than functional lubricants. Preferably, the non-functional lubricant has a molecular weight less than about 1,700 g/mol, and an evaporation rate greater than about 0.01 nm per hour under ambient conditions (e.g., ambient air at 20° C.), and a bonding rate such that the lubricant is capable of being rinsed off with solvent without post-treatment. In some implementations, the molecular weight of the non-functional lubricant is between about 500 g/mol and about 1,700 g/mol, and in others it is between about 500 g/mol and about 1,300 g/mol. For example, in some embodiments, the non-functional lubricant can be a type of perfluoropolyether and/or polyphenoxytriphosphazene lubricant. Further, in certain instances, the lubricant can be fractionated to narrow the molecular weight distribution of the lubricant.

In certain embodiments, the non-functional lubricant is Fomblin Z®. More specifically, the non-functional lubricant can be fractionated from Fomblin Z Z02®. In certain embodiments, the non-functional lubricant may comprise Fomblin Y®, Fomblin Y Y04®, Fomblin Y Y06®, Demnum®, or Krytox®.

In still other embodiments, a method of burnishing media comprises bonding a first lubricant to media; loading and rotating the media in a burnishing device; applying a tape (e.g., polishing, burnishing, abrasive or wiping tape) to the rotating media while applying a second lubricant to the tape, such that at least some of the second lubricant is transferred from the tape to the media but does not bond with the media; and removing the polished media from the burnishing device and evaporating substantially all of the second lubricant from the polished media at ambient conditions within 24 hours.

Figure 4:
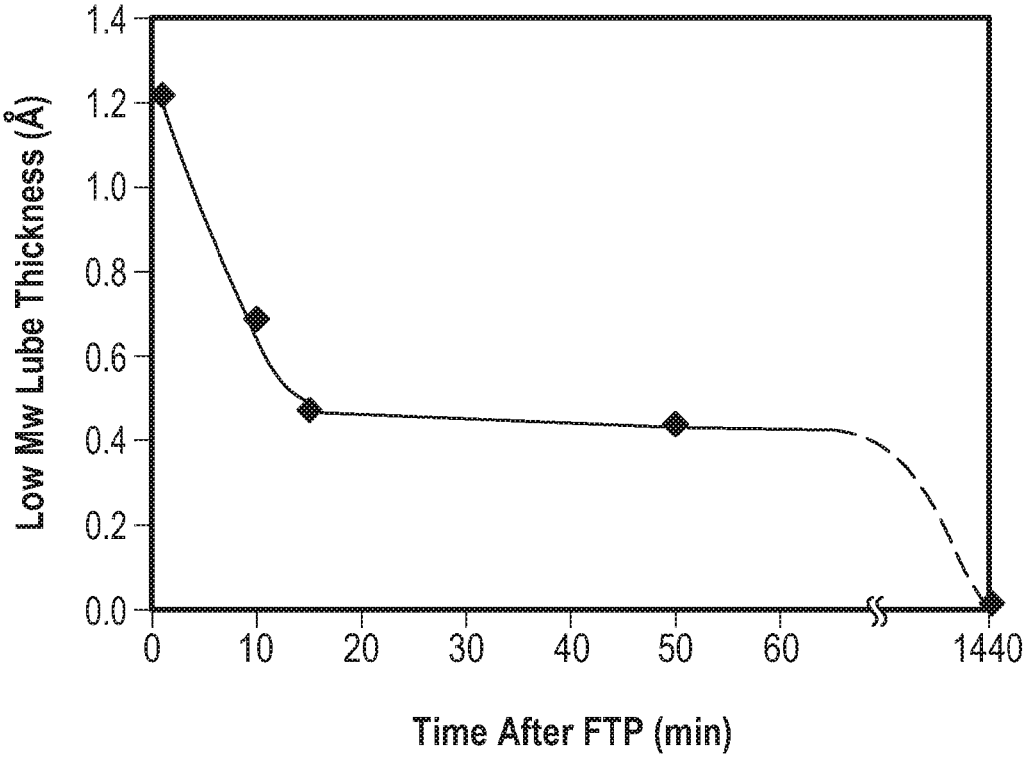
FIG. 4 is a plot of thickness of lubricant on media over time after burnish.

The second lubricant comprises a low molecular weight, non-functional, free lubricant that does not bond with the media. The molecular weight may be about 500 to 1700, or about 1000 to 1600 in other embodiments. The second lubricant may be neat and undiluted with solvent. The second lubricant may comprise fractionated Fomblin Z Z02®. The second lubricant may be applied to the polishing tape by wiping or from above by dripping. The first lubricant may have a relatively high molecular weight, such as Z-Tetraol or Z-Tetraol multidentate (ZTMD) lubricant. The second lubricant may be transferred to the media at a thickness of about 1.3 Å or less. See, e.g., FIG. 4. FIG. 4 is a plot of the thickness of the lubricant on the media over time after burnish. In some embodiments, at least half of the second lubricant may evaporate from the polished media within 15 minutes.

Although specific examples of possible non-functional lubricants are described above, in some embodiments, other lubricants having physical properties and characteristics similar to those described above can be used. Moreover, although in the above exemplary embodiments, the non-functional lubricant solely comprises a lubricant having a single molecular structure, in other embodiments, the non-functional lubricant can be a mixture of two or more of the above-described or other similar non-functional lubricants having associated molecular structures.

Using evaporation to remove the lubricant from the disk provides several advantages over conventional processes. In conventional lubricant removal processes, the lubricant is removed using degreasers or solvents, thus introducing additional tooling steps, personnel, solvents, maintenance, floor area, and ultimately costs. Removing the non-functional lubricant through evaporation techniques virtually eliminates the above shortcomings associated with conventional lubricant removal process.

The embodiments described herein have numerous other advantages over conventional solutions. The lubricant is applied to the tape rather than to the media. Conventional pre-dipping of media in lubricant using solvent does not work with polishing tape. This solution does not require a fixed time delay for lube-to-burnish. It also avoids a mixed lubricant bath or a double dipping process. This solution allows media to have a final lubricant thickness and uniformity that is precise within about 0.05 nm in disk drive products.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A method of processing media, comprising:
bonding a first lubricant to media;
loading and rotating the media in a burnishing device;
applying a tape to the rotating media while applying a second lubricant to the tape, such that at least some of the second lubricant is transferred from the tape to the media, and the second lubricant is neat, undiluted and has a lower molecular weight than the first lubricant;
evaporating substantially all of the second lubricant from the media within 24 hours.

2. A method according to claim 1, wherein the second lubricant comprises a low molecular weight, non-functional, free lubricant that does not bond with the media.

3. A method according to claim 1, wherein the second lubricant has a molecular weight of about 500 to 1700.

4. A method according to claim 1, wherein the second lubricant has a molecular weight of about 1000 to 1600.

5. A method according to claim 1, wherein the second lubricant comprises fractionated Fomblin Z Z02®.

6. A method according to claim 1, wherein the second lubricant is applied to the polishing tape from above by dripping or wiping.

7. A method according to claim 1, wherein the first lubricant has a relatively high molecular weight comprising a Z-Tetraol or Z-Tetraol multidentate (ZTMD) lubricant.

8. A method according to claim 1, wherein the second lubricant is transferred to the media at a thickness of about 1.3 Å or less.

9. A method according to claim 1, wherein at least half of the second lubricant evaporates from the polished media within 15 minutes.

10. A method of burnishing media, comprising:
bonding a first lubricant to media;
loading and rotating the media in a burnishing device;
applying a tape to and burnishing the rotating media while applying a second lubricant to the tape, such that at least some of the second lubricant is transferred from the tape to the media but does not bond with the media, and the second lubricant has a thickness of about 1.3 Å or less;
removing the burnished media from the burnishing device and evaporating substantially all of the second lubricant from the burnished media at ambient conditions within 24 hours.

11. A method according to claim 10, wherein the second lubricant comprises a low molecular weight, non-functional, free lubricant that does not bond with the media.

12. A method according to claim 11, wherein the second lubricant has a molecular weight of about 500 to 1700.

13. A method according to claim 11, wherein the second lubricant has a molecular weight of about 1000 to 1600.

14. A method according to claim 10, wherein the second lubricant is neat and undiluted with solvent.

15. A method according to claim 10, wherein the second lubricant comprises fractionated Fomblin Z Z02®.

16. A method according to claim 10, wherein the second lubricant is applied to the polishing tape from above by dripping or wiping.

17. A method according to claim 10, wherein the first lubricant has a relatively high molecular weight comprising a Z-Tetraol or Z-Tetraol multidentate (ZTMD) lubricant.

18. A method according to claim 10, wherein at least half of the second lubricant evaporates from the polished media within 15 minutes.

19. A method of burnishing media, comprising:
bonding a first lubricant to media;
loading and rotating the media in a burnishing device;
applying a tape to and burnishing the rotating media while applying a second lubricant to the tape, such that at least some of the second lubricant is transferred from the tape to the media but does not bond with the media, and the second lubricant comprises a neat, undiluted, non-functional, free lubricant that does not bond with the media, the second lubricant has a molecular weight of about 1000 to 1600, and the second lubricant has a thickness of about 1.3 Å or less;
removing the burnished media from the burnishing device and evaporating at least half of the second lubricant evaporates from the polished media within 15 minutes, and substantially all of the second lubricant from the burnished media at ambient conditions within 24 hours.

20. A method according to claim 10, wherein the second lubricant comprises fractionated Fomblin Z Z02®, and the first lubricant comprises a Z-Tetraol or Z-Tetraol multidentate (ZTMD) lubricant.

* * * * *

UNITED STATES PATENT AND TRADEMARK OFFICE

CERTIFICATE OF CORRECTION

PATENT NO. : 8,607,425 B2
APPLICATION NO. : 13/040652
DATED : December 17, 2013
INVENTOR(S) : Xing-Cai Guo et al.

It is certified that error appears in the above-identified patent and that said Letters Patent is hereby corrected as shown below:

In the Claims

Col. 8, line 26, delete "polishing" from claim 16.

Signed and Sealed this
Twenty-eighth Day of October, 2014

Michelle K. Lee

Michelle K. Lee
*Deputy Director of the United States Patent and Trademark Office*